US005688325A

United States Patent [19]

Aidun

[11] Patent Number: 5,688,325

[45] Date of Patent: *Nov. 18, 1997

[54] COATING DEVICE FOR TRAVELING WEBS

[75] Inventor: Cyrus K. Aidun, Marietta, Ga.

[73] Assignee: Institute of Paper Science and Technology, Inc., Atlanta, Ga.

[ * ] Notice: The term of this patent shall not extend beyond the expiration date of Pat. No. 5,366,551.

[21] Appl. No.: 683,136

[22] Filed: Jul. 18, 1996

Related U.S. Application Data

[60] Continuation of Ser. No. 291,144, Aug. 16, 1994, abandoned, which is a division of Ser. No. 881,512, May 12, 1992, Pat. No. 5,366,551, which is a continuation-in-part of Ser. No. 849,530, Mar. 11, 1992, abandoned.

[51] Int. Cl.[6] ..... B05C 3/02

[52] U.S. Cl. ..... 118/410; 118/419

[58] Field of Search ..... 118/410, 411, 118/419; 427/434.3, 434.4

[56] References Cited

U.S. PATENT DOCUMENTS

| | | | |
|---|---|---|---|
| 3,113,884 | 12/1963 | Kohler | 118/410 |
| 4,839,201 | 6/1989 | Rantanen et al. | 118/410 |
| 4,920,913 | 5/1990 | Knop et al. | 118/410 |
| 4,945,855 | 8/1990 | Eklund et al. | 118/410 |

*Primary Examiner*—Brenda A. Lamb

*Attorney, Agent, or Firm*—Fitch, Even, Tabin & Flannery

[57] ABSTRACT

The present invention is directed to a coating device for application of coating material to the surface of a web or a flexible substrate. The coating device contains a pressurized channel where a flowing stream of the coating liquid first comes into contact with the substrate. The coating liquid enters the channel at the upstream side and wets the substrate as it flows in the same direction as the substrate. A doctor element is positioned at the downstream side of the channel where the excess coating in the channel follows the contour of the boundary formed by the doctor element and leaves the channel. The geometry of the streamlined boundaries of the coating device eliminate the formation of recirculating eddies or vortices. The elimination of vortices eliminates flow instability due to centrifugal forces and removes harmful pressure fluctuations which could result in coat-weight nonuniformities. The elimination of recirculating eddies or vortices also removes the possibility of entrapping air pockets or air bubbles in the core of the vortices which could reach the blade gap and could result in coat-weight nonuniformities and wet streaks.

9 Claims, 2 Drawing Sheets

COATING DEVICE FOR TRAVELING WEBS

This application is a continuation, of application Ser. No. 08/291,144 filed Aug. 16, 1994, now abandoned, which is a divisional application of Ser. No. 07/881,512, filed May 12, 1992, now U.S. Pat. No. 5,366,551, which is a continuation-in-part of application Ser. No. 07/849,530, filed Mar. 11, 1992 now abandoned.

CROSS-REFERENCE TO RELATED APPLICATION

This application is a continuation-in-part of application Ser. No. 849,530 filed Mar. 11, 1992.

FIELD OF THE INVENTION

The present invention relates generally to a coating device for uniform coating of a traveling web of material. More particularly, the present invention relates to a short-dwell coater which eliminates the captive pond associated with short dwell coaters and provides the coating material in the form of a flowing stream of coating material which flows in the same direction as the web movement.

BACKGROUND OF THE INVENTION

One of the most significant changes in light weight coated (LWC) paper production is the use of the short-dwell coater. The short-dwell coater has enabled the paper maker to improve productivity while maintaining coated paper quality. The term "short-dwell" refers to the relatively short period of time that the coating is in contact with a web of paper material before the excess is metered off by a trailing doctor blade. As shown in FIG. 1, prior art short-dwell coaters consist of a captive pond 21 just prior to the doctor blade 23. The pond is approximately 5 cm in length and is slightly pressurized to promote adhesion of the coating to the paper web 25. The excess coating supplied to the sheet creates a backflow of coating 27. This coating backflow excludes to some extent the boundary layer of air entering with the sheet and eliminates skip coating. The excess coating is channeled over an overflow baffle 29 and collected in a return pan before returning to tanks to be screened.

While short-dwell coaters are extensively used in coating paper webs, such coaters suffer from a major problem. The flow in the coating chamber of the pond upstream of the doctor blade contains recirculating eddies or vortices which can result in coat-weight nonuniformities and wet streaks or striations in several ways. For example, these eddies can become unstable due to centrifugal forces and result in the generation of unsteady flow and rapidly fluctuating vortices, which deteriorate the coating uniformity and its quality. Also, the vortices tend to entrap small air bubbles which result in the buildup of relatively large air inclusions in the coating liquid which tend to accumulate in the core region of the eddies. Vortex fluctuations tend to force these air inclusions into the blade gap. This adversely affects the coating quality. Usually, the presence of air inclusions results in regions of lower coat weight which are 2–4 cm wide and about 10–100 cm long, known in the industry as "wet streaks". These problems are discussed in an article "*Principles of Hydrodynamic Instability: Application in Coating Systems*", C. K. Aidun, Tappi Journal, Vol. 74, No. 3, March, 1991.

It would be desirable to provide a coating device which has the coating advantages of a short-dwell coater, but which did not have the problems associated with recirculating eddies or vortices and the entrapment of air pockets or air bubbles in the core of the vortices.

Accordingly, it is a principal object of the present invention to provide a vortex free short-dwell coating device.

These and other objects will become more apparent from the following description and the appended claims.

SUMMARY OF THE INVENTION

The present invention is directed to a coating device for application of coating material to the surface of a web or a flexible substrate. The coating device contains a pressurized channel where a flowing stream of the coating liquid first comes into contact with the substrate. The coating liquid enters the channel at the upstream side and wets the substrate as it flows in the same direction as the substrate. A doctor element is positioned at the downstream side of the channel where the excess coating in the channel follows the contour of the boundary formed by the doctor element and leaves the channel. The geometry of the streamlined boundaries of the coating device eliminate the formation of recirculating eddies or vortices. The elimination of vortices eliminates flow instability due to centrifugal forces and removes harmful pressure fluctuations which could result in coat-weight nonuniformities. The elimination of recirculating eddies or vortices also removes the possibility of entrapping air pockets or air bubbles in the core of the vortices which could reach the blade gap and could result in coat-weight nonuniformities and wet streaks.

DETAILED DESCRIPTION OF THE INVENTION

Figure 1:
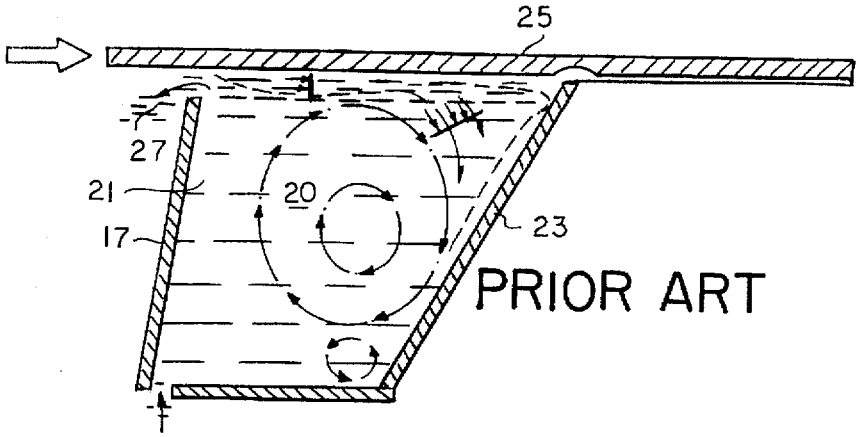
FIG. 1 is a schematic cross-sectional view of a prior art short-dwell coating device.
Figure 2:
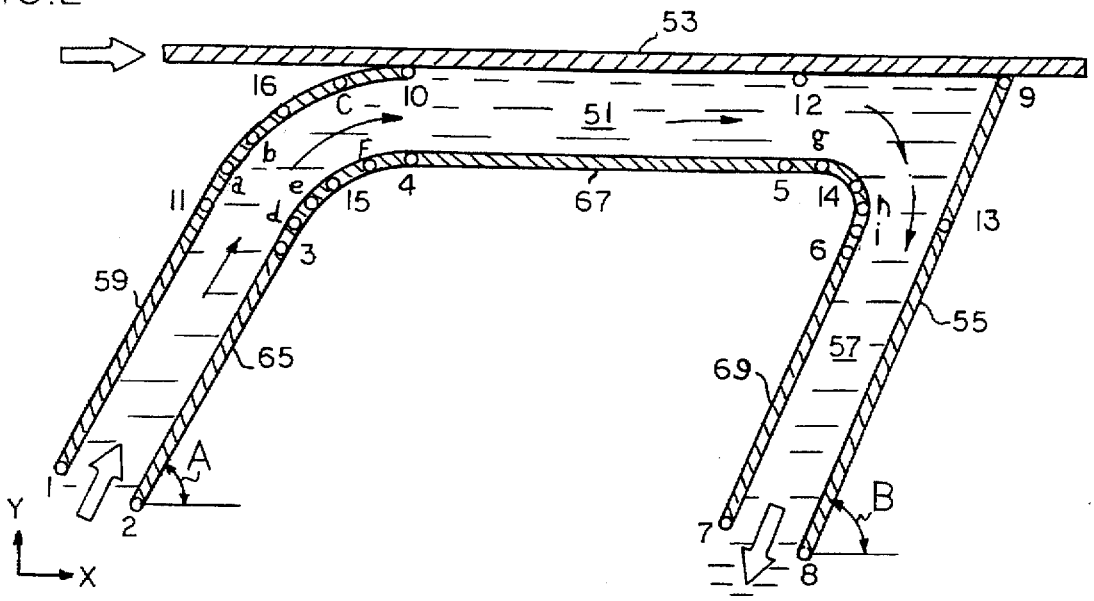
FIG. 2 is a schematic cross-sectional view of a short-dwell coating device in accordance with the present invention.

As shown in FIG. 2, the short-dwell coating device of the present invention consists of a continuous channel of coating material which passes through a coating chamber 51 which is in contact with a web 53 of material which is to be coated. The coating device comprises straight and curvilinear wall sections. For purposes of orientation and discussion, the coating chamber has an upstream side and a downstream side with respect to movement of the web with the upstream side being to the left of FIG. 1. The use of the terms "horizontal" and "vertical" are with respect to a horizontal orientation of the web. The web, however, is usually supported on a counter roll and has a slight curvature in the region of the coating chamber.

The coating device includes a doctor element 55 which is spaced from the web for defining the thickness of the coating on the web. The doctor element 55 extends across the web transversely to the direction of the web motion. The doctor element also forms a downstream boundary wall of the coating chamber 51 and extends downwardly for a further distance to define the downstream wall of an exit plenum 57.

An upstream boundary wall 59 defines the upstream side of the coating chamber 51. The upstream boundary wall 59 extends downwardly for a further distance to define the upstream side of an entrance plenum 61. The upstream boundary wall 59 terminates at its uppermost end in contact with the web 53. As shown in FIG. 2, the terminal end of the upstream boundary wall 59 preferably has a curvilinear shape so that the terminus of the upstream boundary wall 59 is substantially tangential to the web 53. The upstream boundary wall 59 also extends across the web transversely to the direction of the web motion.

A continuous interior wall which also extends across the web transversely to the direction of web motion, has discrete sections, which in combination with the upstream boundary wall 59, the web 53 and the doctor element 55, define the entrance plenum 61, the coating chamber 51 and the exit plenum 57, respectively. The first section 65 of the interior wall defines the downstream side of the entrance plenum 61. The first interior wall section 65 is preferably substantially parallel to the upstream boundary wall 59. The first interior wall section 65 preferably undergoes a curvilinear transition to a second interior wall section 67. The second interior wall section 67 defines the bottom wall of the coating chamber 51. The second interior wall section 67 proceeds to a third interior wall section 69, preferably through a curvilinear transition section. The third interior wall section 69 defines the upstream side of the exit plenum 57. Both the second interior wall section 67 and the third interior wall section 69 are preferably substantially parallel to the web and the doctor element 55, respectively.

The upstream boundary wall 59 preferably terminates in a curvilinear section which is substantially parallel to the curvilinear transition section between first interior wall section 65 and second interior wall section 67. The terminal end of the upstream boundary wall 59 is also preferably biased against the web 53 to prevent any coating material from being forced between the terminal end of the upstream boundary wall and the web 53 and to prevent air from entering into the coating material. The biasing may be accomplished through the use of any suitable means, such as by use of a spring or a flexible material.

Figure 4:
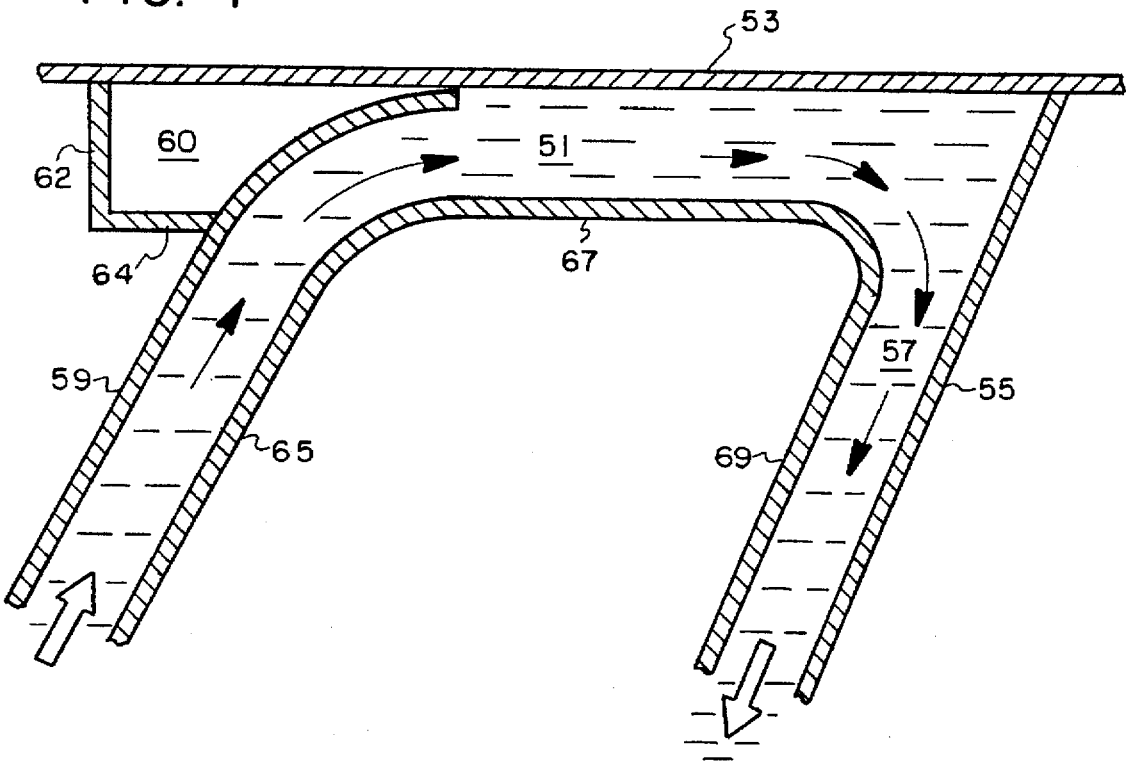
FIG. 4 is a schematic cross-section of a further embodiment of the short-dwell coating device in accordance with the present invention.

As shown in FIG. 4, a vacuum box 60 can be provided to further ensure that no air will become entrained in the coating material. When a vacuum is established in vacuum box 60, the air pressure near the wetting line is reduced, thereby increasing the biasing effect on the boundary wall 59 and preventing any air inclusion at high speeds. The vacuum box 60 is defined by the web 53, the upstream boundary wall and by walls 62 and 64 which extend across the web transversely to the direction of web motion. The outward ends of the vacuum box are capped and one of these ends is fitted to a vacuum source (not shown).

The walls forming the entrance plenum 61 may be vertical at a right angle to web 53. The entrance plenum walls, however, are preferably upwardly inclined in a direction toward the downstream side. The angle A of inclination of the entrance plenum is preferably in the range of from about 10° to about 90°, most preferably about 45°. The walls forming the exit plenum 57 may also be vertical, but are preferably inclined downwardly in a direction toward or away from the upstream side of the exit plenum. The angle B of inclination of the exit plenum is preferably in the range of from about 20° to about 175°, most preferably about 63°.

As an example of construction of the coating device of the present invention, various spatial nodes have been designated in the various walls of the coating device with the numbers 1 through 16. These nodes are identified in the table below with spatial displacements from node 1 in terms of X and Y coordinates. Curve points a through i have also been designated with X and Y coordinates.

TABLE 1

| Node # | X(mm) | Y(mm) | Curve Points | X(mm) | Y(mm) |
|---|---|---|---|---|---|
| 1 | 0 | 0 | a | 32 | 32 |
| 2 | 3.536 | −3.536 | b | 35 | 34 |
| 3 | 34 | 27 | c | 45 | 39 |
| 4 | 52 | 35 | d | 36 | 29 |
| 5 | 85 | 35 | e | 40 | 31.5 |
| 6 | 91 | 25 | f | 47 | 34 |
| 7 | 76.555 | −4.7 | g | 88 | 34 |
| 8 | 81 | −7 | h | 91 | 30 |
| 9 | 105 | 40 | i | 91.5 | 27 |
| 10 | 52 | 40 | | | |
| 11 | 30 | 30 | | | |
| 12 | 85 | 40 | | | |
| 13 | 98 | 26 | | | |
| 14 | 90 | 32 | | | |
| 15 | 43 | 33 | | | |
| 16 | 40 | 37 | | | |

Figure 3:
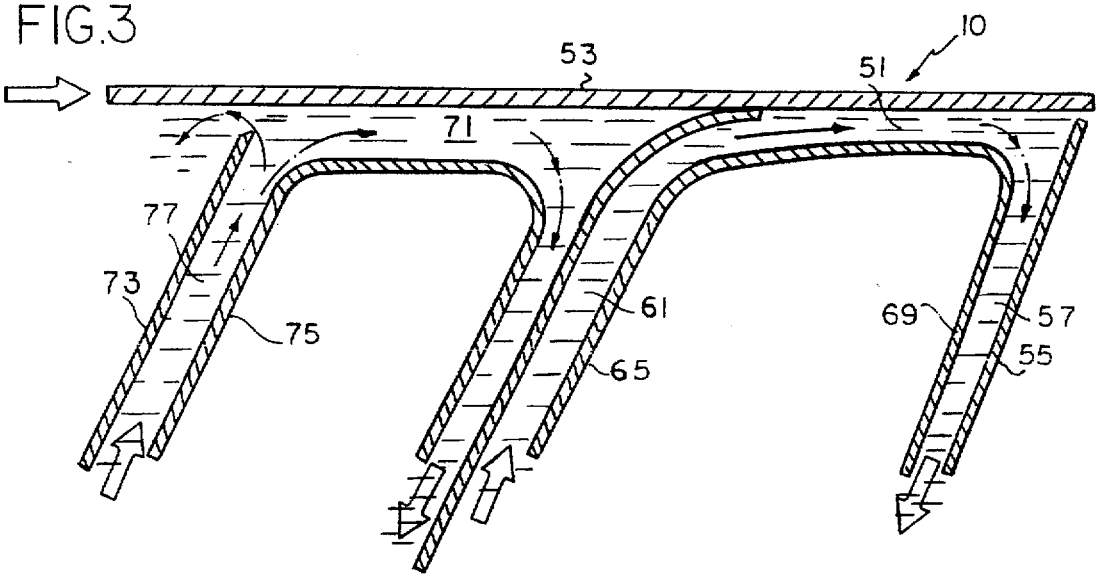
FIG. 3 is a schematic cross-sectional view of another embodiment of the short-dwell coating device in accordance with the present invention.

In another embodiment of the invention, as shown in FIG. 3, a pre-coating chamber 71 is provided on the upstream side of the short-dwell coating device of the invention. The downstream boundary wall of the pre-coating chamber is formed from the upstream boundary wall 59 of the coating device 10. A downstream wall 73 is spaced from web 53 by a distance of from about i to about 5 mm to provide an overflow baffle for coating material to prevent entrance of air in the manner used by prior art short-dwell coaters. The continuous interior wall 75 is used to define an entrance plenum 77, the pre-coating chamber 71 and an exit plenum 79 in the same fashion and with the same parameters as previously described for the coating device.

While various aspects of the invention have been described with particularity, various modifications and alterations to the coating device can be made without departing from the scope of the invention as defined in the appended claims.

What is claimed is:

1. A coating device for applying a liquid coating composition on a web of material as the web travels along a path through the device from an upstream direction to a downstream direction, the device comprising:

a doctor element spaced from the web for spreading and defining the thickness of the liquid coating composition on the web, the doctor element extending across the path of the web;

a coating composition application chamber adapted for receiving a liquid flow of the liquid coating composition from the upstream direction to the downstream direction, the application chamber extending across the path of the web, the application chamber having upstream and downstream sides with the web adapted to travel from the upstream side to the downstream side of the application chamber, the coating application chamber comprising in cross-section, an upstream interior side wall, an upstream boundary wall, a top interior wall, a downstream interior wall and the doctor element, the upstream boundary wall and the upstream interior wall being substantially parallel to the other and each having terminating curvilinear sections which are substantially parallel to the other, the upstream boundary wall having a terminal end adapted to terminate in tangential relation with the path of the web and adapted to prevent coating composition from being forced between the terminal end of the upstream end of the upstream boundary wall and the path of the web, the top interior wall being spaced from and substantially parallel to the path of the web and abutting the upstream interior wall, the downstream interior wall being substantially parallel to the doctor element and abutting the top interior wall; the upstream walls, the top interior wall, the path of the web, the downstream interior wall and the doctor element defining a geometry for the coating device having a path for a flowing stream of the liquid coating composition which flows downstream relative to the direction of travel of the web and which path is for the elimination of the formation of recirculating eddies and vortices in the coating composition and for the elimination of the formation of air pockets in the liquid coating composition.

2. A coating device in accordance with claim 1 wherein said terminal end of the upstream boundary wall is biased against the web.

3. A coating device in accordance with claim 1 wherein the upstream boundary wall and the upstream interior side wall are upwardly inclined in a direction toward the downstream side.

4. A coating device in accordance with claim 3 wherein the inclination is at an angle of from about 10° to about 90°.

5. A coating device in accordance with claim 4 wherein the angle of inclination is about 45°.

6. A coating device in accordance with claim 1 wherein the downstream interior wall and the doctor element are downwardly inclined in a direction respectively toward or away from the upstream side.

7. A coating device in accordance with claim 6 wherein the downward inclination is at an angle of from about 20° to about 175°.

8. A coating device in accordance with claim 7 wherein the downward inclination is at an angle of about 63°.

9. A coating device in accordance with claim 1 which device further includes a vacuum device for establishing a vacuum, the vacuum device is arranged on the upstream side of the upstream boundary wall for maintaining contact between a portion of the upstream boundary wall and web so as to prevent air inclusion into the liquid coating composition in the coating application chamber as the web travels along the path past the coating device.

* * * * *